United States Patent [19]

Edmundson

[11] 3,965,975

[45] June 29, 1976

[54] BAFFLING ARRANGEMENTS FOR CONTACTORS

[75] Inventor: Charles W. Edmundson, Leawood, Kans.

[73] Assignee: Stratford Engineering Corporation, Kansas City, Mo.

[22] Filed: Aug. 21, 1974

[21] Appl. No.: 499,152

[52] U.S. Cl. ..... 165/108; 23/285; 259/4 AC; 259/95

[51] Int. Cl.[2] ..... F28F 13/12; B01F 5/10

[58] Field of Search ..... 165/108, 109; 259/4 AB, 259/4 AC, 95; 23/285

[56] References Cited

UNITED STATES PATENTS 3,284,537 11/1966 Webb ..... 23/285 X 3,759,318 9/1973 Putney et al. ..... 165/108 X

*Primary Examiner*—Albert W. Davis, Jr.

*Attorney, Agent, or Firm*—Thomas M. Scofield

[57] ABSTRACT

Improvements in horizontal, continuously internally circulating contacting-mixing devices of the type having therewithin an impeller, a circulating tube and (usually) an indirect heat exchanging tube bundle; providing baffles or baffling in large volume low velocity zones in the circulation path of such devices in order to increase velocity therewithin and create shear and turbulence, thus to improve mixing; providing baffles or baffling in the annulus or circulating tube (or both) of such devices which extend substantially normal to the conventional axial direction of flow in such vessels in order to markedly change the flow patterns and flow characteristics in the baffled zones.

12 Claims, 17 Drawing Figures

BAFFLING ARRANGEMENTS FOR CONTACTORS

CONTACTORS (Circulating, Mixing, Reaction Vessels)

Contactors are continuous mixers utilizing internal circulation with an impeller, a circulation tube and (usually) an indirect heat exchange tube bundle.

One basic purpose of a contactor is to obtain the greatest possible circulation and turbulence of the internal fluids. Newly input fluids are typically discharged immediately before the impeller, upstream, within the circulating tube. These fluids hit the eye of the impeller and are dispersed in the circulating reaction mix. Thus, a contactor is typically a high volume vessel with a high velocity internal circulation rate. This results in a maximum number of passes through the mixing impeller.

From the process standpoint, the contactor is a device for carrying out chemical and physical reactions and processes under conditions providing intimate contact between feed material, whether in a single phase or more than one phase. An axial flow impeller provides very high shear and turbulence to bring reactants into intimate contact so that the reaction can occur at a maximum rate. In general, the requirements for efficient reaction include (1) temperature control with concurrent removal or addition of reaction heat (2) intimate contact between the reactants and (3) control of the reaction time. When more than one phase is involved, additional requirements include phase dispersion and homogeneity of the reaction mix. By proper design of a contactor, these various requirements may be optimized for the particular reaction involved.

Thus, this type of reactor may be readily equipped with heat exchange means for the addition or removal of reaction heat thereby to maintain essentially isothermal conditions throughout the reaction zone. High internal circulation is maintained so that any heat generated or required by the reaction may be compensated by heat exchange and the reaction may be accomplished under isothermal conditions.

As mentioned, the contactor may be used with a number of combinations of phases. Thus, it is effective for reactions taking place in a single liquid phase, and two or more immiscible liquid phases, with a combination of liquid and solid phases, gas-liquid phases, or gas-liquid-solid phases. In cases where more than one phase is present in the reaction zone, the impeller accomplishes very complete dispersion of one phase in the other and provides an homogeneous mixture of the phases throughout the reaction zone. In these latter cases, the reaction not only proceeds at the phase boundary and a finely divided dispersion of the discontinuous phase for most of the completion of the reaction.

BASIC ELEMENTS AND OPERATION OF THE CONTACTOR

1. The contactor shell serves to contain the reaction mixture.

2. The circulation tube serves to establish an internal flow path in the contactor (down the center of the circulation tube and thereafter throughout the annulus between the circulation tube and the shell).

3. The hydraulic head contains shaft sealing means and any required bearings for the impeller shaft, also incorporating a reversal zone for the flow leaving the impeller (or going to the impeller if the flow is reversed).

4. The impeller effects mixing and circulation in the contactor.

5. Indirect heat exchanging means containing a heat exchanging medium. Generally shown as a tube bundle for addition or removal of heat absorbed or generated during the reaction. The bundles may be of the U-tube type, bayonet tube or others. Also sometimes used for heat exchange are jacketed shells and jacketed circulation tubes.

In typical operation, the conventional flow path within the contactor, starting from the discharge side of the impeller, is through the reversal area in the hydraulic head, thereafter through the annular space between the circulation tube and the outer shell, thereafter through a reversal area in the opposite end of the contactor, and finally through the center section of the contactor within the circulation tube back to the impeller. The reactants are normally fed as near as possible to the eye of the impeller so that they are immediately and thoroughly mixed and dispersed into the main body of the reaction mix.

In some circumstances, it may be advantageous to reverse the flow within the contactor, thus going first through the center section within the circulation tube, into a first reversal zone at the end of the circulation tube opposite that containing the impeller and then back through the annular space between the circulation tube and the shell into the hydraulic head, thence into the other side of the impeller. In these instances, the reactants are conventionally fed into the annular space between the shell and circulation tube as near as possible to the impeller.

THE PRIOR ART

The instant apparatus and process improves over the following prior art constructions and methods relating to horizontally oriented contacting vessels:

Putney et al U.S. Pat. No. 3,759,318, issued Sept. 18, 1973 for "Contactor Improvements";

Webb, Jr., U.S. Pat. No. 3,284,537, issued Nov. 8, 1966 for "Method Of Charging Reactants Through Concentric Feed Tubes";

H. W. Stratford, U.S. Pat. No. 3,027,243, issued Mar. 27, 1962 for "Reaction Vessel With Internal Circulation Tube And Agitator";

Webb, Jr., U.S. Pat. No. 3,027,242, issued Mar. 27, 1962 for "Concentric Injector For Circulating Tube Reactor";

D. H. Putney, U.S. Pat. No. 2,979,308, issued Apr. 11, 1961 for "Apparatus For Controlling Temperature Change Of Blends Of Fluids Or Fluids In Finely Divided Solids";

H. W. Stratford, U.S. Pat. No.. 2,909,634, issued Oct. 20, 1959 for "Process And Apparatus For Chemical Reactions";

D. H. Putney, U.S. Pat. No. 2,800,307, issued July 23, 1957 for "Apparatus For Controlling Temperature Change . . .".

BRIEF DESCRIPTION OF THE INVENTION

The instant improvement with respect to contactor type vessels involves the use of non-axial and orifice baffling within:

1. the circulation tube alone;
2. the annulus between the circulating tube and the outer shell alone; or
3. both in the circulation tube and the annulus.

The provision of straightening vanes in contactors (particularly positioned adjacent the impeller on both the suction and discharge sides thereof) is old. The purpose of straightening vanes is to maintain flow direction, velocity and the mixing state. The purpose of the subject baffling in one or both of the circulated tube and annulus is, in contrast, to increase mixing within the vessel.

For a given horizontal contactor configuration, as the volume of the vessel is increased, the mixing efficiency and effect of the impeller decreases. Thus, the number of times the contactor contents are recycled through the impeller during the residence time defines the contacting efficiency. As volume increases the circulation rate must be increased to achieve the same number of passes through the impeller for a given residence time. However, after a certain point, increasing circulation rate becomes impractical. This is particularly true in the presence of a tube bundle, as excessive pressure drop is encountered.

The provision of the instant baffling improvements reduces the number of required passes through the impeller and the required circulation rate, thus lowering the required pumping effort.

Typical design parameters of contactors include residence time (volume), the duty of the heat exchanger and the mixing required (the number of times recycled through the impeller in the residence time). Twenty of 50 passes through the impeller for a given contactor process is typical and conventional. Baffling of the improved type often reduces the required number of passes by one-half. The presence of the baffles requires a fewer number of recycle times through the impeller during a given residence time to achieve a given mixing-contacting effect in a given vessel.

If an impeller along is present in a conventional contactor, this is substantially the only mixing factor in the vessel. Where there is, additionally, a tube bundle, the passage of the circulating fluid through the tube bundle structure affords an additional mixing factor. In the instant improvement, the presence of baffling with the impeller provides an additional mixing factor. The presence of baffles with impeller and tube bundle provides a third mixing factor within a vessel.

The use of baffling as herein disclosed permits the building of larger volume contactors while still obtaining efficient mixing. This improvement permits the building of larger but efficient contactors than those which are made possible by the improvement in U.S. Pat. No. 3,759,318, Putney et al, issued Sept. 18, 1973 for "Contactor Improvement". It is also feasible and possible to baffle as herein disclosed in the eccentric form contactor seen in said Putney et al U.S. Pat. No. 3,759,318 and such improvement is within the scope of the instant improvement. The baffling provided by the instant invention differs in action from the improvement of the eccentric contactor of Putney et al U.S. Pat. No. 3,759,319. In the latter, the configuration of the contactor insures that whole vessel circulation is achieved, particularly with multi-phase and stratifying mixtures. The instant improvement actually achieves counter-current mixing of phases with flow reversals which are not obtained in said Putney et al U.S. Pat. No. 3,759,318 and the prior art.

OBJECTS OF THE INVENTION

An object of the invention is to provide improvements in circulating, mixing reaction devices of the contactor type (which typically utilize internal circulation in a vessel having a shell, a circulation tube, an impeller and (usually) a heat exchanging tube bundle), said means permitting the employment and use of much larger volume contactor type vessels.

Another object of the invention is to provide structural and functional improvements to contacting and mixing devices of the horizontal contactor type. These improvements are directed to obtaining improved mixing, through increased shear and turbulence, particularly in low velocity flow zones, thereby to make practical the use of larger volume contactors of all types.

Another object of the invention is to provide structural improvements in horizontal contactors of all types, which improvements make feasible larger volume structure in a given vessel type, coupled with achievement of the desired and necessary results in terms of circulation, mixing, shear and turbulence.

Another object of the invention is to provide baffling structure in large size contactor vessels wherever a low velocity zone is encountered either inside the circulating tube or in the annulus between the circulating tube or the shell, the baffles so configured as to increase velocity, affect mixing, increase shear annd create turbulence, also increasing heat exchange when there is a tube bundle present.

Another object of the invention is to provide new elements for contactor vessel constructions operative to induce desired additional shear and turbulence in the circulating reaction mixture within the vessel over and above that normally produced by the mixing-circulating impeller.

Another object of the invention is to provide more efficient contactor vessel designs which will meet a much wider range of process requirements.

Another object of the invention is to provide improvements in contactor vessel construction involving various structural alternatives which incorporate shear and turbulence producing elements, whereby to produce contactors which will handle many reactions requiring a wide range of design and operating conditions.

Another object of the invention is to provide improvements in a horizontal contacting device having a shell, a circulating tube, an impeller and an hydraulic head (but no tube bundle or heat exchanging means within the circulating tube) where internal baffling is provided within the circulating tube of such character as to increase velocity, induce turbulence and thereby greatly improve the mixing capacities of this particular type of vessel.

Another object of the invention is to provide structural improvements in a contacting device having a shell, a circulation tube, an impeller in one end of the circulation tube and a large tube bundle in the other end of the circulation tube, the improvements particularly including baffling within the annulus between the circulation tube and the outer shell which baffles operate to increase velocity, turbulence, shear and mixing in this particular zone, thereby increasing the efficiency of the vessel and further permitting the use of a greater volume annulus space than previously employed without degradation of the effectiveness of the mixing vessel.

Another object of the invention is to provide improvements in the structural configuration of a large volume contacting vessel having an outer shell, a circulation tube therewithin, an impeller in one end of the circulation tube and a relatively short length tube bundle in the other end of the circularing tube, the improvements comprising the provision of such baffling structure in both the annulus between the circulating tube and the shell and the interior of the circulating tube that velocity is increased therewithin, as well as shear, turbulence and mixing, whereby to retain efficiency of mixing in such a large vessel having large volumes in the said two areas, namely, the annulus between the shell and the circulating tube and the interior of the circulating tube between the impeller and the short tube bundle.

Another object of the invention is to provide an improved contactor mixing vessel having a long, small diameter heat exchanging tube bundle (more efficient with some type of coolants). In this case, the improved structural configuration involves the vessel shell, an outer circulation tube within the shell, an inner circulation tube within the outer circulating tube, the tube bundle within the inner circulating tube and baffling provided in the annulus zone between the circulating tubes, which baffling provides a pressure drop for flow in that zone which balances the pressure drop for flow through the tube bundle, thereby to maintain high velocity flows in all zones of the contactor.

Another object of the invention is to provide and disclose specific baffling configurations for use in the shell-circulation tube annulus of contactor devices of certain configurations, which baffles optimize the contactor vessel for use in reactions with specific requirements, changing the pressure drop and velocity through the annulus, and increasing the shear and turbulence within said zone.

Another object of the invention is to provide a plurality of baffling configurations for use within circulation tubes of contactor type mixers and reactors, the baffling providing longer flow paths, a higher pressure drop, shear and turbulence and twists in the flow path.

Another object of the invention is to provide improvements in the internal construction of contactors which will permit the effective utilization of these vessels in larger volume configurations than heretofore used, the volume changes achieved by increasing the length of the contactor vessel, the diameter thereof or both simultaneously without loss of mixing and circulation qualities.

Other and further objects of the invention will appear in the course of the following description thereof.

In the drawings, which form a part of the instant invention and are to be read in conjunction therewith, embodiments of the invention are shown and, in the various views, like numerals are employed to indicate like parts.

FIG. 1 is a side sectional view of a circulating-mixing reaction vessel of the contactor type characterized by the absence of indirect heat exchanging elements (a tube bundle) and the presence of baffling elements (schematically indicated) positioned within the circulating tube.

FIG. 2 is a side sectional view of a second circulating-mixing reaction vessel of contactor type, this vessel having a large, elongate U-section heat exchanging tube bundle penetrating the end of the circulating tube opposite the impeller and extending substantially the entire length thereof, improved baffling elements provided within the increased annulus space between the circulating tube and the vessel shell.

FIG. 3 is a side, sectional view of a third form of contactor vessel like that of FIG. 2, but differing therefrom in that the tube bundle heat exchanger is of lesser length, whereby baffling elements are provided within both the increased annulus between the circulating tube and the shell and within the circulating tube between the tube bundle and the impeller.

FIG. 4 is a side sectional view of a fourth form of contacting vessel differing from those of the previous three figures in that a long, lesser diameter tube bundle is employed within the vessel within an inner circulating tube, the vessel further having an outer circulating tube with such baffling in the annulus between the two circulation tubes that the pressure drop through the tube-tube annulus balances the pressure drop for flow through the inner tube bundle.

FIG. 5 is a side sectional view of a contactor like that of FIG. 3, the flow within the vessel reversed to that illustrated in FIG. 3, however.

FIGS. 6–11, inclusive show types of baffling which may be used in the center section of the contactor inside the circulation tube. Specifically, that is, these figures show types of baffling usable inside the circulation tube of FIG. 1, inside the circulation tube of FIGS. 3 and 5 and in one case (FIG. 11) utilizable between the two circulation tubes of FIG. 4, as well as inside the circulation tubes of FIGS. 1, 3 and 5. In each of FIGS. 6–11, inclusive, the circulation tube within which the baffles are positioned are shown as a transparency within which the baffles are mounted for better illustration of the configuration of the structure and mounting of the baffles within the cylindrical portion of the circulation tube. Each one of these views is also a three-quarter perspective view taken from above.

FIGS. 12–16, inclusive show five alternative forms of annulus (between shell and circulation tube) baffles. In order to better illustrate the configuration of the baffles with respect to the circulation tube-outer shell annulus, the outer shell is shown as a first, outer transparency, the cylindrical portion of the circulation tube shown as a second, inner transparency, each of the views three-quarter perspective from above.

Figure 12:
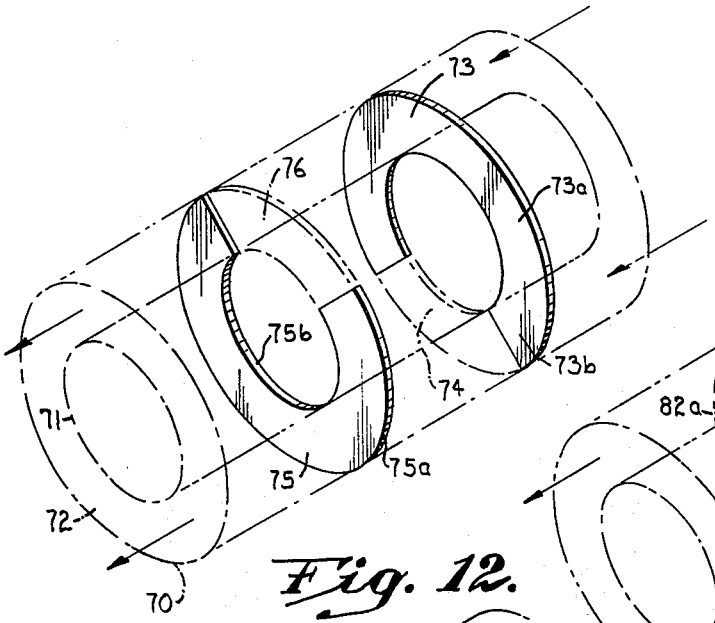

FIG. 12 is a view showing a pair of annulus baffles each comprising an incomplete hollow centered ring filling the annulus between the circulation tube and the outer shell, the gaps in each of the hollow centered rings or flanges rotated with respect to one another.

Figure 13:
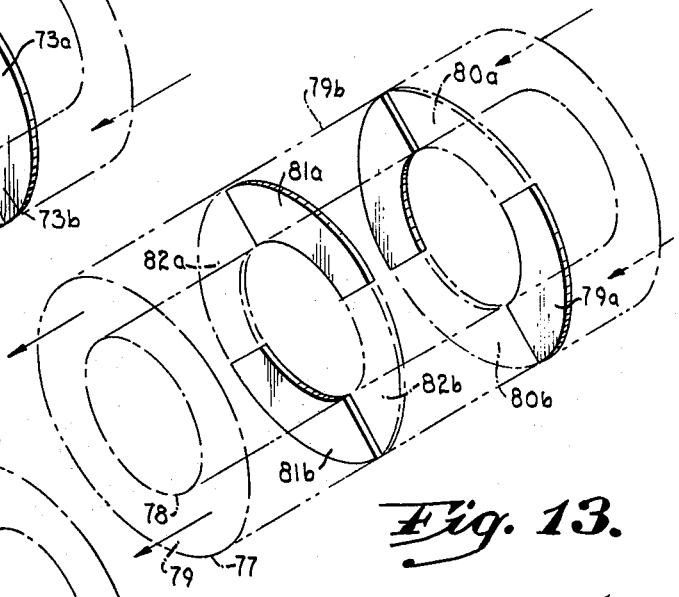

FIG. 13 is a second form of annulus type baffles, each baffle comprising a pair of hollow center ring segments spaced from one another, the gaps in the rings rotated with respect to one another.

Figure 14:
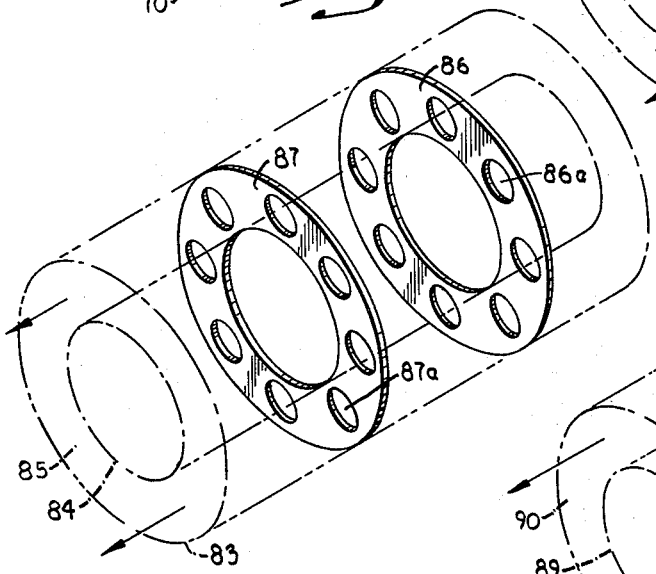

FIG. 14 shows a pair of annulus baffles of a third type, each baffle comprising a hollow centered ring or flange, a plurality of holes or perforations provided through each ring flange.

Figure 15:
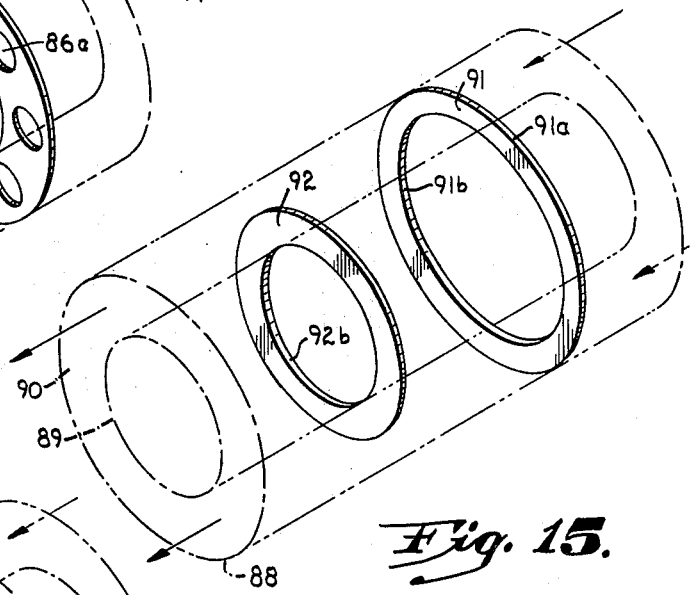

FIG. 15 is a fourth type of circulation tube-outer shell annulus baffle, two baffles shown, each a complete, continuous ring within the annulus, neither of them filling the annulus.

Figure 16:
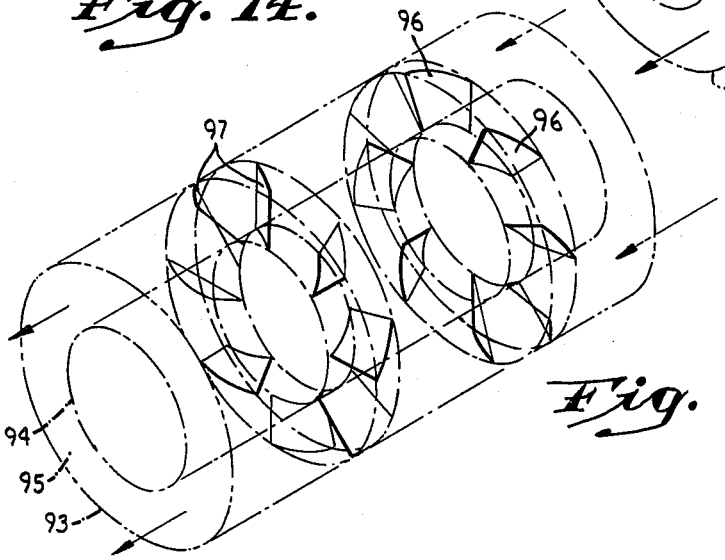

FIG. 16 is a fifth form of annulus filling baffles, the two sets of baffles made up of propeller type blades, the pitch of the blades reversed between the two sets of baffles.

Figure 17:
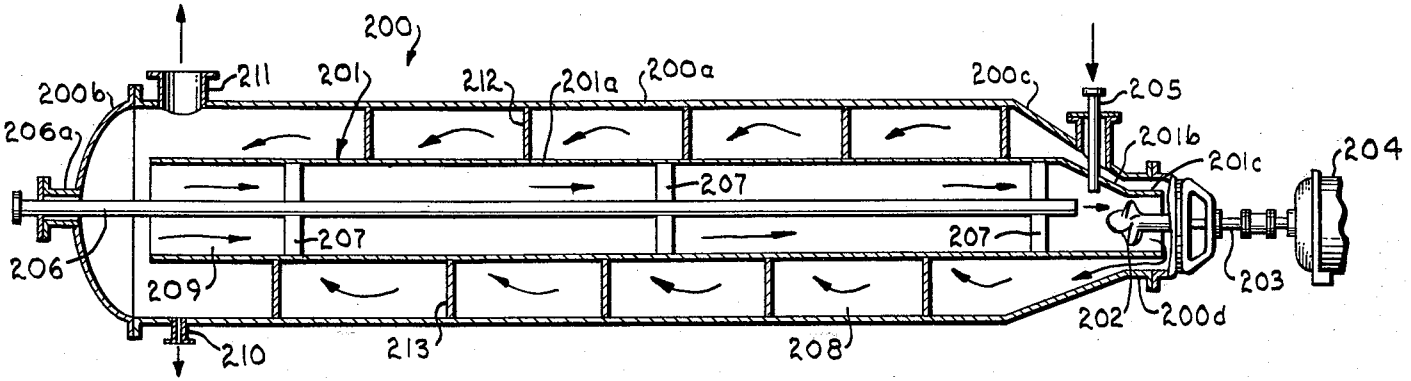

FIG. 17 is a side sectional view of a contactor vessel without heat exchange surface (tube bundle) within the circulating tube wherein annulus baffling is employed.

FIGURE 1-BASIC CONTACTOR STRUCTURE

Figure 1:
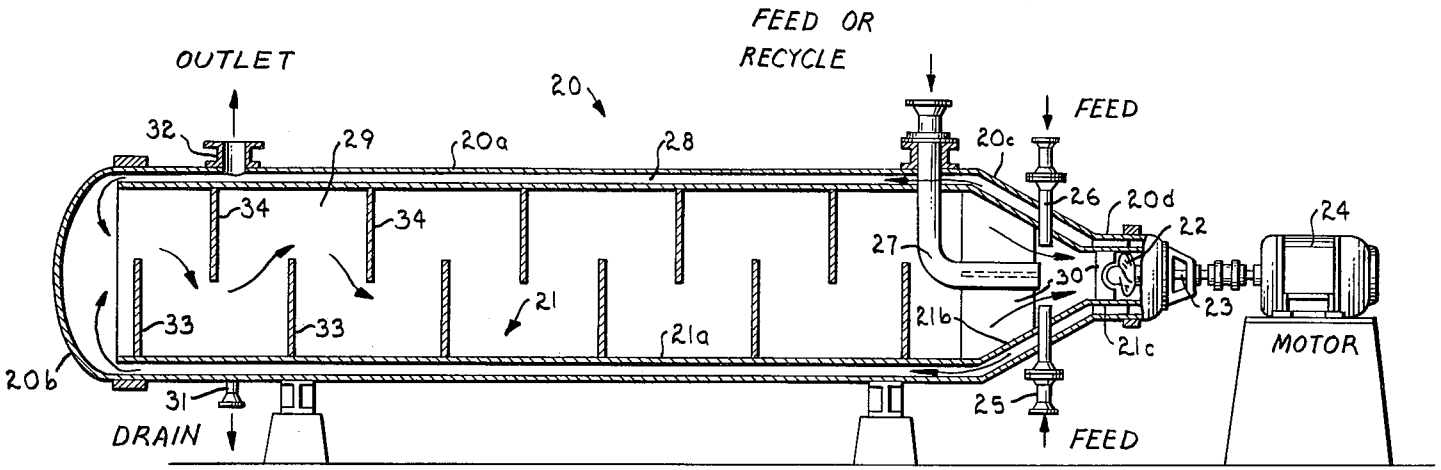

Referring to FIG. 1, the structure will be first generally described with respect to parts common to all horizontal contactor reactors of its class, and, thereafter, the particular improvements comprising the instant invention described.

Referring then to FIG. 1, the horizontal contactor reactor therein shown has an outer shell generally designated 20 made up of central portion 20*a* of cylindrical configuration, an end closure 20*b* of arcuate section, an opposite end portion 20*c* of progressively restricted configuration and an hydraulic pumping head portion 20*d*. Within shell 20 there is provided a circulating tube generally designated 21 which is concentrically positioned within the shell and has portions thereof generally congruent in configuration to the outer enclosing shell 20 next thereto. That is, there is elongated cylindrical tube portion 21*a* open at its left end in the view of FIG. 1, tube portion 21*b* of progressively decreasing internal diameter and opposite end portion 21*c* received within the hydraulic pumping head portion 20*d* of the outer shell. The end 21*c* is open as may be best seen in the modified showing of FIG. 2.

A pumping impeller 22 is located in the circulating tube portion 21*c* mounted on shaft 23 which rotates in a bearing mounted in the pumping head 20*d*, sealed by suitable packing glands. Impeller 22 is driven by a suitable prime mover 24, such as a driving motor, turbine or engine.

Nozzles or feed lines 25, 26 and 27 are provided for feeding components of the blend or mixture to be circulated in the contactor into the vessel. They extend both through the outer shell 20 and inner circulating tube 21 whereby to discharge the reaction mixture components immediately in front of (typically on the upstream side) of impeller 23. Impeller 23 is thus arranged for taking suction from circulating tube 21 and discharging into hydraulic pumping head 20*d*. Within the latter, the flow of fluid is reversed and directed into the annular space 28 between the outer shell 20 and circulating tube 21. At the other end of the vessel (to the left in FIG. 1) flow is reversed at the arcuate closure 20*b*, thereafter passing interiorly of the circulating tube at 29 and thence into the restricted volume portion defined by tube part 21*b*, thereafter into the impeller. Straightening vanes 30 may be provided as seen at 30 in the tube portions 21*b* and 21*c*.

A separate drain nozzle 31 is provided on the underside of the outer shell 20 to serve in emptying the shell or machine. Nozzle 32 is provided, typically on the upper surface of the outer shell, for withdrawing the finished blend of components.

Figure 2:
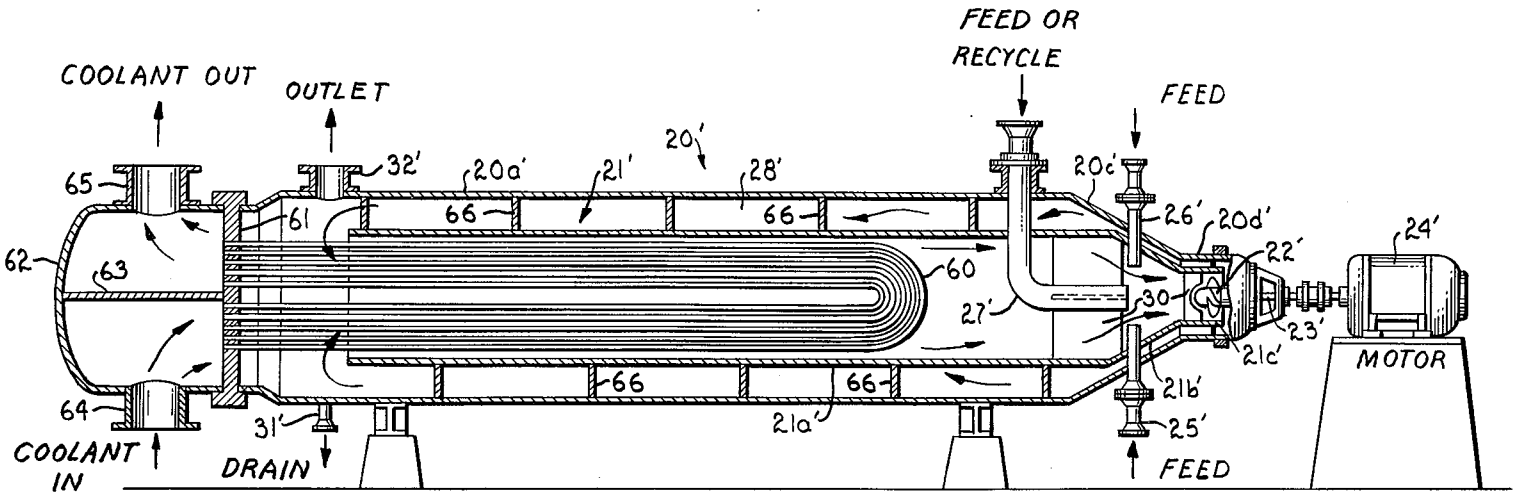
Figure 3:
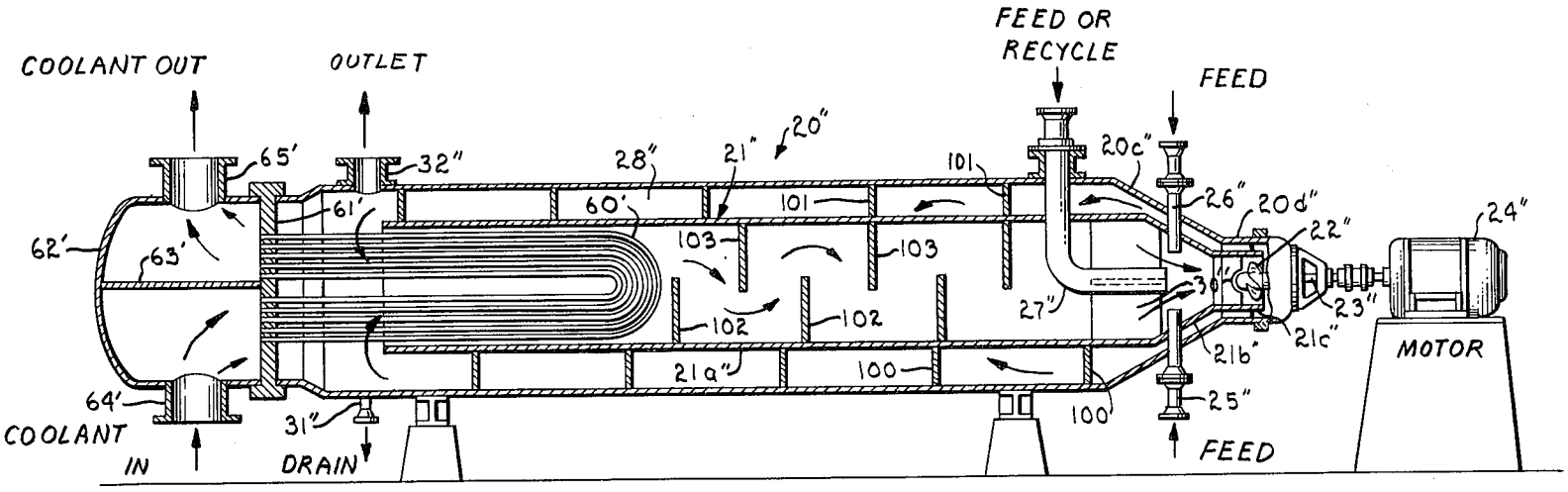

The contactor of FIG. 1 does not employ a tube bundle or heat exhange element inside of the circulating tube as is seen in the forms to be described in FIGS. 2 and 3. However, it should be understood that the outer shell may be jacketed for the circulation of heating or cooling medium between the jacket and outer shell to provide some heat exchange. Likewise, the circulating tube per se may be jacketed to give a double wall construction for circulation of heat trnasfer of fluid therebetween. This would provide a heat exchange surface within the body of the circulating stream and the vessel.

In this type of apparatus, the impeller 22 picks up the components introduced through nozzles 25–27, inclusive and causes them to circulate as a blend through the mixing impeller into the annular space between the outer shell and the circulating tube. At the opposite end of the vessel, the travel of the flowing steam is reversed and the blend or mixture caused to pass through the interior of the circulating tube.

Suitable connections are made to nozzles 25–27, inclusive, and valves provided to control the quantity of feed input components introduced into the vessel. Suitable sources of supply are also provided and suitable pipe connections thereto. Discharge pipes are in each case connected to outlets 31 and 32 equipped with suitable valves to drain off the fluids in the vessel when desired.

FIG. 1 - IMPROVEMENT

FIG. 1 illustrates a contactor design particularly useful for reactions in which there is little or no reaction heat involved. Thus, in some cases involving a low heat of reaction, it is possible to precool the feed streams in order to compensate for the heat evolved during the reaction. Alternatively, jacketing of the shell and/or the circulating tube or parts thereof may be sufficient to handle any heat evolution. However, if a fairly long reaction (residence) time is required, the necessary contactor volume becomes great enough that it is difficult to maintain high velocities and turbulence throughout the entire circulation path within the reactor vessel.

The design conditions for such a reactor can be improved by incorporating two features of structure or configuration. In the first place, the annular space between the circulation tube and the shell is kept small so that high velocity flow is experienced in this zone. However, in a large contactor, when the annular space is minimized as stated and there is no heat exchanging tube bundle as in FIGS. 2 and 3 within the circulating tube (which inherently provides turbulence, pressure drop and mixing in passage of the fluids therethrough) the nominal flow velocity through the center section of the contactor within the circulating tube (at 29) is very low. In the case of a two-phase liquid system, for example, this could result in demulsification of the phases.

In this condition, then, the design parameters for the reactor can be markedly improved by the addition of suitable baffling within the circulation tube. Such baffling provides a longer flow path through the center section at increased velocity and the shear effect of flow across edges of the baffles and the turbulence which is induced by eddying the flow reversal around the baffles serve to promote the desired mixing and increased dispersion betwen the phases.

Accordingly, in the showing of FIG. 1 there is provided a first form of internal circulation tube baffling to achieve the immediatly described effect in the form of a plurality of spaced, half circle lower elements 33 having like upper elements 34 positioned therebetween. These baffles may be perforated, if desired for a limited interrupted flow therethrough, but in any case, will force the circulating fluids to pass over each of the lower baffles and under each of the upper baffles in an undulating path as seen by the arrows within the circulation tube 21 in the left-hand portion thereof. Thus, the provided baffles 33 and 34 incorporated within the circulation tube 21 induce additional shear and turbulence in the circulating reaction mixture over and above that produced by the mixing-circulating impeller. Additionally, they permit the employment of a lesser volume or space in the annulus 28 whereby to provide high velocity flow there.

Figure 6:
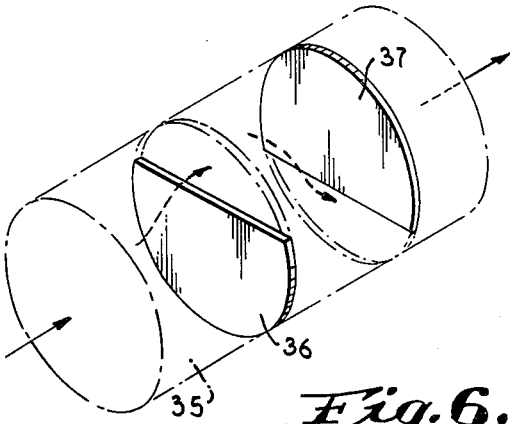
FIG. 6 is a three-quarter view from above of a circulation tube of a contactor, the circulation tube shown as a transparency, two baffles shown mounted therein comprising portions of circular discs with portions of the discs removed to permit flow therepast.

FIG. 6 shows a perspective view of the internal circulation tube baffles of the contactor of FIG. 1.

INTERNAL CIRCULATION TUBE BAFFLE CONFIGURATIONS

FIGS. 6–11, inclusive show alternative types of baffling usable in the center section or interior of the circulation tube. Among the effects achieved by these various baffling configurations are the provision of a longer flow path, increase of pressure drop, increased shear, turbulence and mixing, twisting of the flow path, increase of velocity and combinations of these effects. In all of these figures the flow is from left to right in the views and the circulation tubes are schematically designated as transparencies to best show the baffle structure.

Referring to FIG. 6, a portion of the cylindrical portion of the circulation tube is represented as transparent at 35. A pair of horizontally oriented, greater than half circle baffles 36 and 37 are provided interiorly of such circulation tube 35, whereby the flow path is increased in length and diverted around each of the baffles. Baffles 36 and 37, being segments of circular sheets, are actually the same as the baffles seen in FIG. 1.

Figure 7:
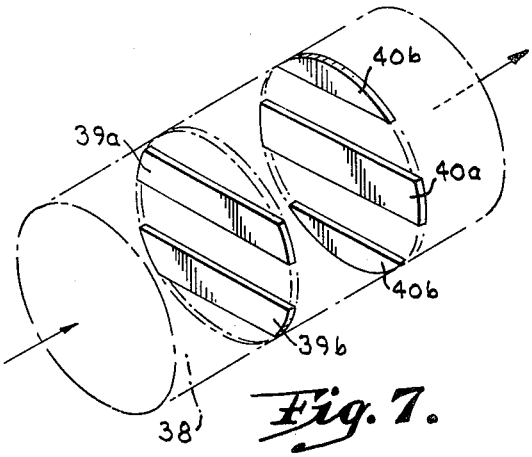
FIG. 7 is a three-quarter perspective view from above of the circulation tube of a contacting vessel, the circulation tube shown as a transparency, two baffles shown of differing configuration from one another, the baffles parts of circular disc, one baffle consisting of those parts removed from the other baffle to make a complete circular disc and vice versa.

FIG. 7 shows horizontally oriented baffling within a circulation tube shown as a transparency at 38. A first set of baffles comprises paired elements 39*a* and 39*b* which permit flow centrally therebetween and around the peripheries thereof. Baffles 39*a* and 39*b* are fastened at their ends to the inside surface of the circulation tube 38. The second set of baffles (also secured at their ends to the inside of the circulating tube) comprises a central member 40*a* with side segments 40*b*. The segments 39 and 40 complement one another (together would form a complete 360° disc filling the center of the tube).

Comparing the configurations of FIGS. 6 and 7, the full segments in FIG. 6 provide a longer flow path and generally a higher pressure drop than the split segments of FIG. 7. However, the configuration of FIG. 7 provides greater shear and turbulence due to the flow impinging, splitting, and eddying around the split segments 39*a* and *b* and 40*a* and *b*.

It should be appreciated in each of the modifications of FIGS. 6–11, inclusive, the elements of each set of baffles may be, if desired, rotated with respect to one another to a greater or lesser degree, or together, with respect to the circulation tube.

Figure 8:
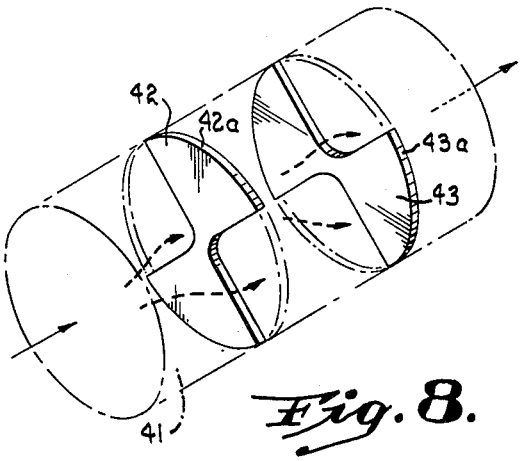
FIG. 8 is a three-quarter view from above of a third internal circulation tube baffling arrangement, the circulation tube shown as a transparency, each baffle of identical configuration (double ax head or hour glass configuration), one baffle rotated 90° with respect to the other.

Looking at FIG. 8, therein is shown a circulation tube 41 having a pair of hourglass or double ax head type baffles 42 and 43 spaced therewithin, one of said baffles rotated 90° with respect to the other. Surfaces 42*a* and 43*a* are fixed to the inside surface of tube 41. This configuration provides a fairly large shear area at the edges and also incorporates a 90° twist in the flow path.

Figure 9:
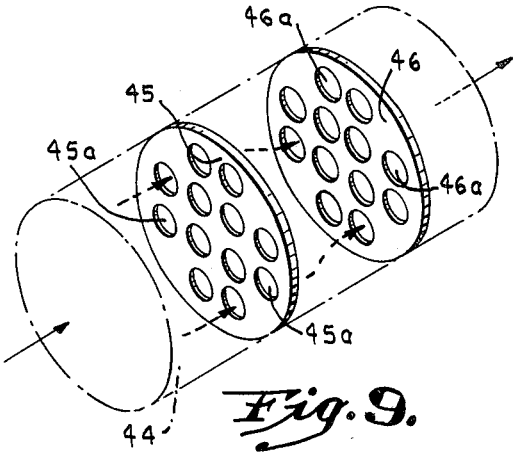
FIG. 9 is a fourth form of internal circulation tube baffling for the cylindrical portion of a contactor circulation tube, the view is three-quarter from above, the cylindrical portion of the circulation tube shown as a transparency, the two baffles comprising circular discs having a plurality of perforations therethrough.

In FIG. 9, therein the circulation tube 44 contains a pair of circular baffle discs or sheets 45 and 46 each having a plurality of holes or perforations 45*a* and 46*a*, respectively, therethrough. Each of these baffles completely fills the tube 44. These perforated baffles 45 and 46 provide a relatively high pressure drop and a very high shear effect when a large number of relatively small holes is used.

Figure 10:
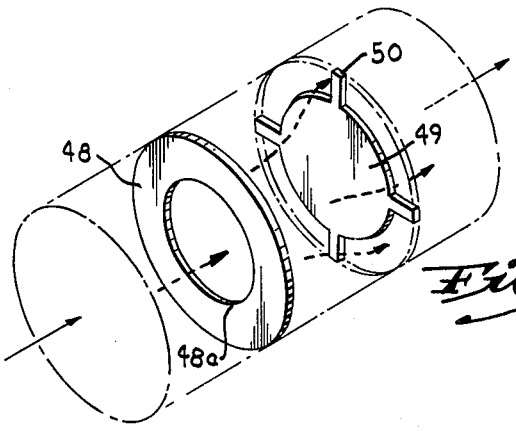
FIG. 10 is a fifth form of internal circulation tube baffles, the view three-quarter from above, the circulation tube shown as a transparency, two baffles shown, one a hollow centered disc or doughnut, the second a solid disc of lesser diameter than the internal diameter of the circulation tube with support members centering same.

Turning to FIG. 10, the circulation tube 47 contains two baffles therewithin. The first one in the direction of flow, designated 48, is a hollow center disc or donut with all flow through the center opening 48*a*. The second baffle is a circular disc 49 of lesser outer diameter than the internal diameter of the circulation tube. Disc 49 is mounted centrally with respect to the latter by a plurality of beams or legs 50. All flow past baffle 49 is around the periphery thereof. The impingement on and directional changes in the flow caused by the edges of the baffles induce a fair degree of shear and turbulence while providing a relatively low pressure drop in this baffle configuration.

Figure 11:
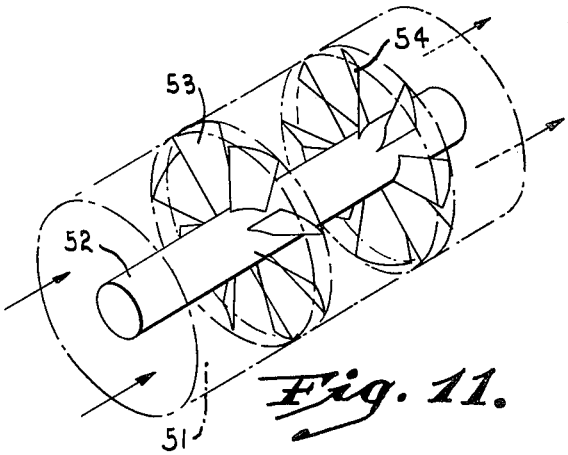
FIG. 11 is a sixth form of internal circulation tube baffles, the view three-quarter perspective from above, the circulation tube shown as a transparency, two baffles shown, each of multiple blade or propeller type, the pitch reversed between alternate baffles (compare FIG. 17).

In the modification of FIG. 11, circulation tube 51 receives centrally thereof an elongate shaft or tube 52 which may be either hollow or solid. There are two sets of baffles shown spaced within tube 51 and along shaft 52, each set comprising a plurality of propeller type blades or baffles 53 and 54, respectively. Baffle blades 53 and 54 are fixed at their inner ends on shaft 52 and at their outer ends to the inner surface of circulation tube 51. The configuration shown has the pitch reversed on the blades between the sets 53 and 54. This type, while expensive and complicated to construct, probably provides the greatest shear and turbulence of any of the modifications shown in FIG. 6–11, inclusive. Yet further, the potential of greatest control over pressure drop is present by changing the pitch of the blades of the sets of baffles.

The selection amoung the particular baffle types of FIGS. 6–11, inclusive will depend upon the available ppressure drop, the normal velocity through the flow zone without baffles, and the degree of additional shear and turbulence desired. As the contactor of FIG. 1 is applicable to numerous reactions requiring different conditions for efficient production of the desired product, the alternatives illustrated show several variations in design which may be used to optimize the contactor for use in reactions with specific requirements. In all cases, however, with respect to application in the contactor of FIG. 1, there is involved, first, the lessened zone or space in the annulus between the shell and the circulating tube to provide high velocity in the annulus and, second, baffling centrally of the circulation tube in the large volume contained therewithin in order to increase velocity, pressure drop and shear and turbulence.

FIG. 2 - TUBE - SHELL ANNULUS BAFFLING

Turning now to FIG. 2, the contacting reaction vessel shown differs from the contactor of FIG. 1 in the following characteristics:

1. There is a heat exchanging tube bundle provided extending into the circulating tube opposite the impeller;
2. This tube bundle extends substantially the entire length of the cylindrical portion of the tube bundles;
3. Additional volume within the contactor is required which must be provided in the annular space between the circulation tube and the shell; and
4. Baffling is provided in the annulus to increase the velocity, shear, turbulence and mixing in this area.

There is one additional structural difference from the FIG. 1 configuration, namely tube portion **21*b* is shortened with respect to the outer shell portion 20*c*** whereby to provide an expanding throat into the baffled annulus. In order to minimize time and space required in the description of generic or universal portions of contacting vessels already described adequately with respect to FIG. 1, parts which are the same or substantially the same in FIG. 2 are numbered the same as the same parts in FIG. 1, but primed. These parts will not be redescribed in detail.

FIG. 2 illustrates a contactor designed to deal with (1) a relatively large quantity of heat of reaction, as well as (2) a relatively large reaction time (residence time) requirement. In the former case a large tube bundle is required. In order to promote the proper flow across the tube bundle, same must fit closely within the circulation tube.

The latter circumstance (relatively long reaction time) requires additional volume within the contactor which, since the required large tube bundle must take up a good deal of the volume within the circulation tube, must be provided in the annular space between the circulation tube and the shell (enlargement of the latter space). In the large contactor of FIG. 2, then, with both a large heat exchange requirement and a large free volume requirement within the shell, baffling is provided in the annulus between the circulation tube and the outer shell to increase velocity, shear, turbulence and mixing in this zone. This baffling is schematically indicated at 66 in FIG. 2 and comprises one of the forms of annulus baffling seen in FIGS. 12–16, inclusive to be described.

Turning to the elements of the contactor of FIG. 2 not seen in FIG. 1, heating or cooling elements 60 in the form of U-bends made of tubing are rolled into or otherwise attached to tube sheet 61 which closes the left end of shell 20' in FIG. 2. These elements extend through the left hand open end of circulating tube 21' (in FIG. 2) and substantially the entire length of the cylindrical portion **21*a*' thereof. A tube bundle of alternative forms such as those seen in the U.S. Pat. of Putney No. 2,800,307, supra, may be optionally provided as an alternative to that form shown. A typical heat exchange medium header 62 having central wall or partition 63 therewithin dividing the tube ends from one another permits distribution of heating or cooling medium to the tubes of the bundle 60. Fitting 64 leads into one side of header 62 and fitting 65** leads from the other side thereof.

Other forms of heat exchange apparatus may be used without altering the concept as well as additional such. For example, the heat exchange element can be in the form of pipe coils, thus eliminating the tube sheet and header or channel construction. The outer shell may additionally be jacketed for the circulation of heating or cooling medium between the jacket and outer shell to supplement the tubular or coil elements. The circulating tube itself may additionally be jacketed to give a double wall construction for circulation of heat transfer fluid therebetween, thus providing additional heat exchange medium within the body of the circulating stream.

ANNULUS BAFFLES (FIGS. 12–16 INCLUSIVE)

FIGS. 12–16, inclusive illustrate baffles usable in the annular space between the circulation tube and the shell. The selection of one of these baffle types will depend upon the available pressure drop, the normal velocity through the flow zone without baffles, and the degree of additional shear and turbulence desired. As a contactor of the type in FIG. 2 (high heat exchange as well as high volume requirements) is applicable to a great many different reactions requiring different conditions for efficient production of the desired product, these variations in baffle design may be used to optimize the contactor for use in reactions with specific requirements. As in the case of the internal circulation tube baffling of FIGS. 6–11, inclusive, combinations of the types shown (if the baffled zone is long enough) may be used. Additionally, angular rotation of one of the baffle sets with respect to the other may be employed.

Turning to FIG. 12, the outer shell is illustrated as transparent at 70 with the circulation tube also illustrated as a transparency at 71. With the direction of flow from right to left in the view of FIG. 12, the first baffle encountered by the flow in the annulus 72 is a hollow ring sheet 73 having but a single break therein at 74. Since the outer periphery of ring sheet 73 seals against the inner face of the shell 70, as well as the inner periphery of the hollow center sealing against the outer surface of the circulating tube, all flow must pass through the opening 74.

The second baffle in the direction of flow, 75, having outer peripheral edge **75*a* and inner peripheral edge 75*b*, is exactly like interrupted ring sheet 73, but rotated 180° with respect thereto, so that the discontinuity or break 76 therein is 180° around the outer surface of the circulating tube away from the opening 74. This configuration provides a long flow path and high pressure drop for the fluids driven through the annulus 72.** This annulus baffling of FIG. 12 may be compared to the center baffling of the circulation tube in FIG. 7 in that there is only one path past each baffle and the gap in each successive baffle is rotated with respect to the gap in the preceding baffle.

In FIG. 13, the outer shell is numbered 77, the inner shell 78 and the annulus therebetween 79. In this example, in the first baffle zone in the direction of flow (from right to left in the view) there are two arcuate segments 79*a* and 79*b*, each sealed peripherally exteriorly to the inside surface of the shell and interiorly to the outer surface of the circulation tube, with a pair of gaps 80*a* and 80*b* therebetween. The arcuate length of each of the segments and the gaps are preferably equal as shown.

In the second baffle zone in the direction of flow there is provided the exact same configuration (of a pair of arcuate segments 81*a* and 81*b* with spaced gaps 82*a* and 82*b* therebetween) with the assembly rotated 90° from the first baffle assembly. While the configuration of FIG. 13 does not provide as long a flow path or as great a pressure drop as the configuration of FIG. 12, there is provided shear and turbulence due to the flow impinging, splitting and eddying around the split segments of each baffle assembly. FIG. 13, as an annular baffling construction is analogous in its effect on the flow of fluids there passed to the configurations of structure of baffles shown in FIGS. 7 and 8 for the center of the circulation tube. That is, the flow is somewhat twisted and there is a plurality of openings at each baffle zone through which the flow passes.

In FIG. 14, the outer shell is designated 83, the circulation tube 84 and the annulus therebetween 85. With the direction of flow from right to left in the view, there is seen two baffles 86 and 87 of like configuration spaced from one another. The structure comprises a ring sheet provided with a plurality of spaced perforations 86*a* and 87*a*, respectively. This configuration provides a relatively high pressure drop and a very high shear effect when a large number of relatively small holes is used. FIG. 14, for the annular baffle, has the same characteristics or comparable characteristics as the baffles of FIG. 9 for the interior of the circulating tube.

In FIG. 15, the outer shell 88 is spaced from the circulation tube 89 by circumferential annulus 90. With the direction of flow from right to left in the view, the flow stream first encounters the continuous ring flange 91 which is continuously sealed to the inner face of shell 88 in its outer peripheral edge 91*a*. The inward edge 91*b* of baffle 91 extends only a fraction of the radial distance towards the outer surface of circulating tube 89 in the annulus 90. Thus there is a continuous flow path in annulus 90 past edge 91*b*.

Downstream of baffle 91 is a second ring flange or baffle 92 having a free outer edge 92*a* in the annulus 90 and an inner surface of edge 92*b* continuously secured to the outer face of circulating tube 89. The width of flange or baffle 92 is less than the width of the annulus 90 whereby there is a continuous flow path past edge 92*a*.

This configuration provides a relatively low pressure drop with some degree of shear and turbulence arising from the flow impingement on the edges of the baffles and the directional changes caused thereby. The annular configuration of baffling in FIG. 15 is analogous to the interior circulating tube baffle configuration of FIG. 10.

Turning to FIG. 16, outer shell 93 is circumferentially spaced from circulating tube 94 by annulus 95. With the direction of flow from right to left in the view, two sets or complexes of baffles are illustrated. This configuration involves propeller type baffles with the illustrated configuration having the pitch reversed on sequential sets of baffles. The first set of blades in the first set of baffles are designated 96, while the blades or baffles of the second set are numbered 97.

FIG. 16 is essentially the same type of baffling for the annulus configuration as is seen in FIG. 11 for the interior of the circulating tube. This type, while expensive and complicated to construct, provides the greatest shear and turbulence. There is also the potential of greatest control over pressure drop (by changing the blade pitch) or any of the alternatives of FIGS. 12–16, inclusive.

FIG. 3 CONSTRUCTION

Turning to the contactor construction illustrated in FIG. 3, this device has all of the parts or elements of the contactor of FIG. 2. That is, there is a shell, a circulating tube, an impeller positioned in one end of the circulating tube and heat exchange means such as a tube bundle extending into the other end of the circulating tube. However, the contactor configuration and arrangement of these basic elements in FIG. 3 is adapted to handling reaction processes producing a generally lesser quantity of heat of reaction while still requiring about the same residence time of circulation of the mix in the vessel. Thus, in this case, a rather short (reduced heat exchange area) tube bundle is provided which is adequate and serves to remove the relatively moderate quantity of heat of reaction. In order to satisfy the volume requirement of the vessel, a relatively large volume or zone is provided in the annulus between the circulating tube and the shell. Additionally, there is available or present a large open volume within the circulating tube between the tube bundle and the impeller.

By baffling in the volume or annular zone between the circulating tube and outer shell and, as well, baffling in the space between the tube bundle and the impeller inside the circulation tube, a high flow rate is maintained at all times in all portions of the vessel and shear, turbulence and mixing are effected thereby to increase the efficiency of dispersion and contacting. Without baffling in each zone (or both of them) undesirable low velocities would be experienced and some phase separation could take place. The annulus baffling is schematically designated 101, while the internal tube baffling is numbered 102 and 103. While the types of baffling in the annulus and circulating tube may be the "same" (ex FIGS. 11 and 16 or FIGS. 6 and 12) they may also differ in structure type while still performing the requisite mixing, etc. functions.

Since there are no new structures in the contactor of FIG. 3 over that shown in FIG. 2, merely the differences above noted, (addition of baffling and shortening of tube portion 21*b*′) the parts which are common to both FIGS. 2 and 1 are numbered the same but double primed, while the parts which are the same with respect to FIG. 2 are numbered the same but single primed. The differences of length of shell zone 20*c*″ and tube zone 21*b*″ provide an expanding zone leading into the baffled annulus 28″ as is the case in FIG. 2.

In operation of the device of FIG. 3, the conventional flow path inside the contactor starts from the discharge side of impeller 22″ (the right side of the impeller in FIG. 3) into and through the reversal area in the hydraulic head 20*d*″ and then up into the annulus between the circulation tubes section 22*b*″ and the shell section 20*c*″. In this instance because tube section 21b'' is shorter than shell section 20c'', there is a short zone after the cylindrical tube portion 21a'' begins where shell portion 20c'' continues to diverge. Said otherwise, the annulus between the circulation tube 21'' and the outer shell 20'' increases in volume in the direction of flow. Thereafter, in the enlarged annulus, baffles of any one or several of the forms in FIGS. 12–16, inclusive, are provided as schematically designated at 100 and 101. The baffles schematically designated are those of FIG. 12, but could be any of the others or their equivalent.

After passing the entire length of the annulus and varying velocity, changing direction and undergoing shear and turbulence as provided by the baffling 100 and 101, the flow is reversed within the shell to the left of the extreme left end of the circulation tube 21''. The fluids being circulated then pass into tube bundle 60' for heat exchange. On departing from the tube bundle, the circulating fluids pass into the zone between the tube bundle and the impeller and are driven into a baffle system schematically designated 102 (lower) and 103 (upper) whereby to increase the velocity, change flow direction and create shear and turbulence. Departing from the baffle system the reactants go into the eye of the impeller 22'' past the input feed lines, receiving any new input, choking down and increasing velocity in the tube section 21b'', straightened by vanes 30'' for another pass through the impeller.

As previously noted, the baffles schematically indicated at 102 and 103 in FIG. 3 may be any of the forms seen in FIGS. 6–11, inclusive or other equivalent.

Also as previously noted, the reactants are normally fed into the vessel as close as possible to the eye of the impeller, whereby to be immediately thoroughly mixed and dispersed into the main circulating body of the reaction mix. The mixing, turbulence and counter-current flow in the circulating flow body created by the presence of the baffles 102, 103 in FIG. 3 achieves not only the prevention of stratification of phases between bundle 60' and impeller 22'' (in a low velocity zone without baffles) but also a markedly better dispersion of mix to the impeller.

When baffling is employed in the annulus or circulation tube, or both, as seen in FIGS. 1–3, inclusive then the action of the impeller is no longer the key to successful mixing action. By virture of the disclosed baffling, low velocity zones are eliminated and, effectively, the entire circulating path of the mix is provided with continuously acting mixing means.

Figure 4:
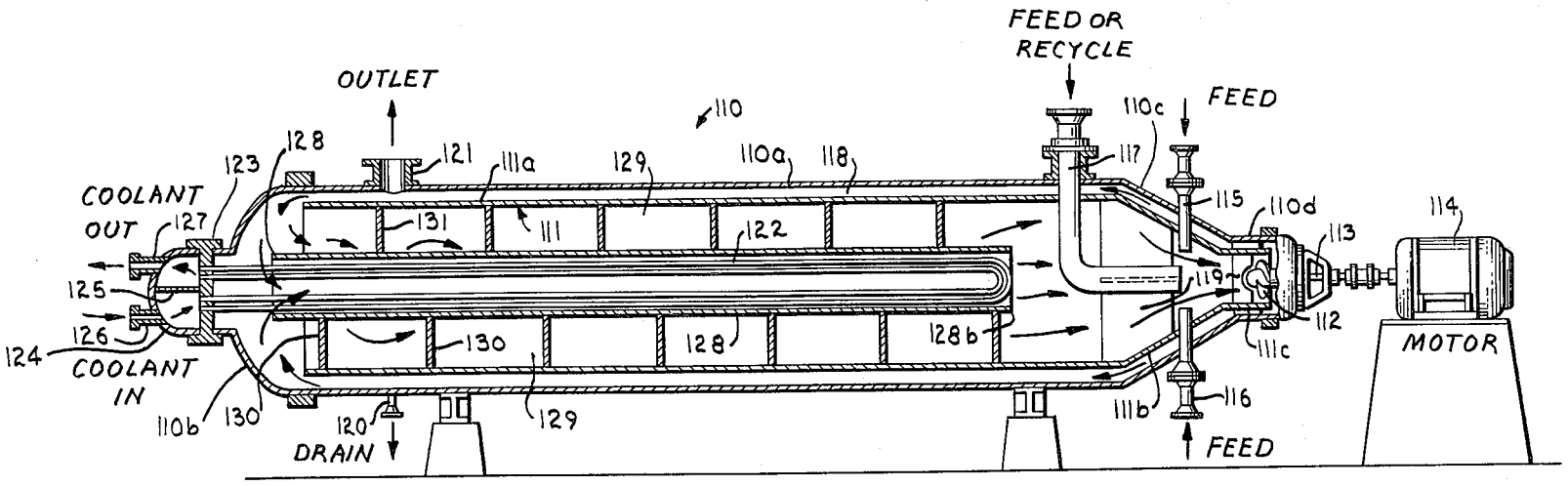

FIG. 4 Modification

The contactor of FIG. 4 is designed basically to handle the same reaction conditions as the contactor of FIG. 3. That is, there is a moderate quantity of reaction heat which must be removed. Yet further, a relatively large reaction time (residence time in the vessel in circulation) is required so that a relatively large free volume for circulation in the vessel must be provided.

However, a long, small diameter tube bundle can be more economical in heat exchange with some types of coolants. Such a bundle is provided in FIG. 4. In order to provide the necessary and proper flow characteristics across the bundle for efficient heat exchange, it is necessary that a small diameter circulation tube be used therewith. Because of the limited flow rate possible through tube 128, a second flow path is provided externally thereof by means of a second circulation tube 111.

Such second circulation tube 111 is provided closely adjacent to and congruent with the shell configuration containing same. With the narrowing down of the annulus between the outer circulation tube and the confining shell high velocity flow is maintained at all times therewithin. The flow within the inner circulation tube provides the desired heat exchanging of the circulating reaction mix. The zone between inner and outer circulation tubes is baffled and the baffles are so selected and configured (as well as arranged) to provide a pressure drop for flow in that zone which will balance the pressure drop for flow through the tube bundle.

Thus, the flow in this contactor is from the impeller into the hydraulic head, through the outer annular space to the opposite end of the contactor. Here the flow splits, part going through the baffled zone between the circulation tubes and part going through the tube bundle within the inner circulation tube. High velocity flows can be maintained in all zones, solely due to the baffling.

Referring then to FIG. 4, the horizontal contactor-reactor therein shown has an outer shell generally designated 110 made up of a central portion 110a of cylindrical configuration, an end closure 110b of arcuate section, an opposite end portion 110c of progressively restricted configuration and an hydraulic pumping head portion 110d. Within shell 110 there is provided a first, outer circulating tube generally designated 111 which is concentrically positioned with the shell 110 and has portions thereof generally congruent in configuration to the outer enclosing shell 110 next thereto. That is, there is elongate cylindrical tube portion 111a open at its left end in the view of FIG. 4, tube portion 111b of progressively decreasing internal diameter to the right in the view of FIG. 4 and lesser diameter form cylindrical portion 111c received within the hydraulic pumping head portion 110b of the outer shell. The right hand end of cylindrical portion 111c is open as shown.

A pumping impeller 112 is located in the circulating tube portion 111c mounted on shaft 113 which rotates in a bearing (not shown) mounted in pumping head 110d, sealed by suitable shaft seals (also not shown). Impeller 112 is driven by a suitable prime mover 114, such a driving motor, turbine, or engine.

Input nozzles or feed lines 115, 116 and 117 are provided for feed of components of the blend or mixture to be circulated in the contactor into the vessel proper. Lines 115–117, inclusive extend both through outer shell 110 and outer circulating tube 111 whereby to discharge reaction mixture components immediately in front of (typically on the upstream side) of impeller 112. In the view of FIG. 4, with the flow indicated by the arrows therewithin, impeller 112 is thus arranged for taking suction from outer circulation tube 111 (and its contents to be described) and discharging the fluids therefrom into hydraulic pumping head 110d. Within the latter, the flow of fluids is reversed and directed into the annular space 118 between outer shell 110 and outer circulating tube 111. At the other end of the vessel (to the left in FIG. 4) flow is reversed at the arcuate closure 110b. Straightening vanes 119 may be provided in the outer circulating tube portion 111b and 111c as shown.

A separate drain nozzle 120 is provided on the under side of outer shell 110 to serve in emptying the shell, vessel or device. Discharge nozzle 121 is also provided, typically on the upper surface of outer shell 110, for withdrawing the finished blend of components after suitable mixing and heat exchange as will be described.

The previously described structures are those included within the contactor configuration of FIG. 1. The tube bundle, second circulating tube and baffling construction to be described now relates to that which is necessary and preferred when a long, small diameter tube bundle (efficient with some types of coolants) is employed or provided in the vessel.

Turning to the elements of novelty of the contactor of FIG. 4, heating or cooling elements 122 in the form of U-bends made of tubing are rolled into or otherwise attached to tube sheet 123 which closes the central portion of the left end of shell 110 in FIG. 4. These elements extend through the left hand open end of outer circulation tube 111 and substantially the entire length of the cylindrical portion 111*a* thereof.

A tube bundle of alternative form such as those seen in U.S. Pat. No. to Putney, 2,800,307, supra, may be optionally provided as an alternative to that form shown. A typical heat exchange medium header or channel 124 having central wall or partition 125 therewithin dividing the tube ends from one another permits distribution of heating or cooling medium to the tubes of the bundle 122. Fitting 126 leads into one side of header 124 and fitting 127 leads from the other side thereof.

Because of the fact that the tube bundle 122 is elongate and of considerably lesser outer diameter than the inner diameter of the outer circulation tube 111, there is provided an elongate cylindrical inner circulation tube 128 closely encircling the periphery of the tube bundle 122. The left hand end 128*a* thereof (in the view of FIG. 4) may extend past the left hand end of outer tube 111*a*. The right hand end 128*b* of inner circulation tube 128 extends at least the length of the tube bundle 122. The purpose of the small diameter inner circulation tube 128 is to provide the proper fluid flow characteristics across the tube bundle 122 in the normal circulation of the fluids in the large volume contactor shell 110. Sufficient entry area into tube 128 and bundle 122 must be available.

In order to provide effective return flow distribution, outer and inner circulation tubes 111 and 128 are provided as a pair. Additionally, the zone 129 between circulation tubes 111 and 128 is baffled. The baffles, schematically designated in the view of FIG. 4 at 130 (lower) and 131 (upper) are so selected as to provide a pressure drop (total) for flow in zone 129 which balances the pressure drop for flow through the tube bundle 122 in circulation tube 128.

Thus it may be seen that there is high velocity and turbulent flow in all zones of the contactor. In the zone defined by portion 111*b* of outer circulation tube 111, flow is accelerating because of the lessening volume in the choked down portion 111*b*. The feeds are added in this zone through lines 115–117, inclusive and there may be provided straightening vanes 119 in this zone as well as in the impeller carrying portion 111*c* of the outer circulation tube 111. The flow then reverses in the hydraulic head portion 110 with the fluids passing out through the small volume annulus 118 where high velocity flow is maintained. At the opposite end of vessel 110 flow is reversed as seen by the arrows and the fluids split between those passing into the inner circulation tube 128 and that quantity passing into the annulus 129 baffles. The presence of the tube bundle as well as the restricted volume in the inner circulation tube and the presence of the baffles in the annulus 129 maintain high velocity flows in these zones. The fluids passing out of the tube bundle 128 and the annulus 129 discharge immediately into the choke down zone 111*b*.

The baffles 130 and 131 are actually those of FIG. 12, but any of the annulus baffles of FIGS. 12–16, inclusive may be employed so long as the pressure drops in the annulus 129 and the inner circulation tube 122 are equalized.

Figure 5:
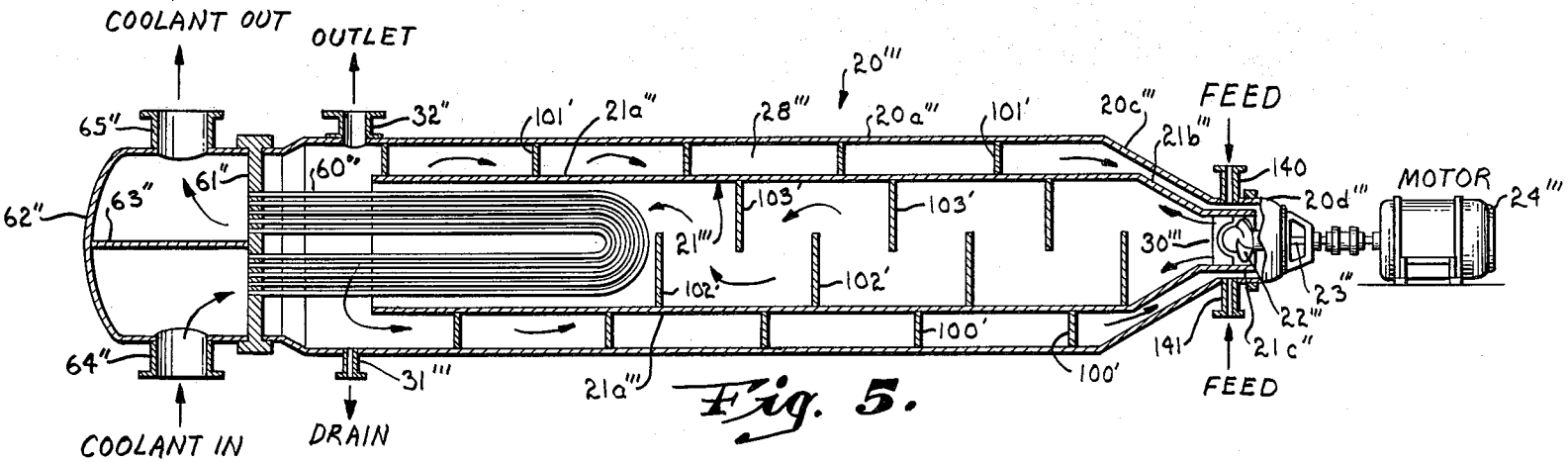

FIG. 5 Modification - Reverse Flow FIG. 3

FIG. 5 illustrates a contactor construction which has many parts thereof exactly like the contactor configuration of FIG. 3. There are only two basic differences: First, the direction of flow of fluids within the contactor is reversed between FIGS. 3 and 5. That is, in FIG. 3, the flow within the circulation tube 21″ is from left to right in the view toward the impeller, thence into the hydraulic head and from right to left in the view of FIG. 3 in the annulus 28″. This flow is reversed in direction in FIG. 5.

Secondly, the inlet feed lines 25″–27″, inclusive, in FIG. 3 all penetrate the circulation tube 21″ so as to discharge immediately before the impeller in the direction of flow. Because the direction of flow is reversed in FIG. 5, the feed lines to be described only penetrate the outer shell and are so positioned thereon as to discharge their feeds immediately before the impeller, as will be described.

Because of the similarities of structure between the contactors of FIGS. 3 and 5, parts which are identical or substantially so in structure are numbered the same, but single, double or triple primed as the case may require with respect to the numbering of the parts in FIG. 3. This expediency avoids redescription of already described structural elements. These numbers thus single, double or triple primed and the parts they designate are not redescribed, but, rather, the description of these parts previously made in the specification are incorporated here by reference.

Feed lines 140 and 141 in FIG. 4 are shown as penetrating only the outer shell portion 20*d‴* so that feed inputs will pass into the circulating fluid stream immediately prior to the stream passing through the impeller. These feed lines 140 and 141 (there may be a multiplicity spaced around the circumference of the vessel) may also be positioned in the shell zone 20*c′* preferably opposite the circulation tube zone 21*b‴*.

As noted with respect to FIG. 3, this contactor configuration is adapted to handling reaction processes producing a generally lesser quantity of heat of reaction while still requiring about the same residence time of circulation of the mix in the vessel. Here, in a high volume contactor vessel, there is a short (but relatively large outer diameter) tube bundle 60′. The annulus 28‴ is of large volume, as well as the zone between the impeller 22‴ and the tube bundle 60″. Therefore, annular baffling (100′ and 101′) and inner circulation tube baffling (102′ and 103′) are both used. Any of the forms of annular baffling of FIGS. 12–16, inclusive may be employed and any of the FIGS. 6–11, inclusive inner circulation tube baffling configurations may be employed.

It is noted that the relatively shorter circulation tube 21*b‴* relative to shell portion 20*c‴* provides an annular tapering or accelerating zone prior to the passage of fluids into the impeller. Likewise, the zone 21*b‴* provides a deceleration zone into the portion of the circulation tube of cylindrical configuration between the impeller and the tube bundle. While feeding into the annulus in FIG. 5 is preferred, it is not absolutely required. Feed lines equivalent to one or more of 26 and/or 27 may be employed alternatively or together with annulus lines 140 and 141. The same is true with respect to using annulus lines 140 and 141 relative to FIGS. 1–4, inclusive. The presence of both sets of lines would permit reversal of flow under most conditions.

FIGS. 1–4, inclusive show contactors which are all inherently flow reversible, if desired. Feed lines position may be significant with respect to flow reversal under certain circumstances as noted. The presence of baffling close on the impeller discharge make feed input on the suction side of the impeller less critical.

FIG. 17

FIG. 17 shows a modified form of contactor vessel which is absent indirect heat exchanging means analogous to the vessel of FIG. 1. However, in this particular vessel structure, a considerable proportion of the volume thereof is located outside of the circulation tube, essentially opposite to the vessel of FIG. 1. In order to provide the desired velocity in the circulation tube-shell annulus, as well as shear, turbulence and adequate mixing in this zone, the annulus is baffled along one of the lines seen in FIGS. 12–16, inclusive. The circulation tube then essentially serves as a suction pipe for return of fluids to the impeller after passage through the baffled annulus with its additional mixing effect.

Referring, then, to FIG. 17, the horizontal contactor reactor therein shown has an outer shell generally designated 200 made up of a central portion 200*a* of cylindrical configuration an end closure 200*b* of arcuate section, an opposite end portion 200*c* of progressively restricted configuration and an hydraulic pumping portion generally designated 200*d*. Within shell 200 there is provided a circulating tube generally designated 201 which is concentrically positioned within the shell and has portions thereof generally congruent in configuration to the outer enclosing shell 200 next thereto. That is, there is elongate cylindrical tube portion 201*a* open at its left and in the view of FIG. 17, tube portion 201*b* of progressively decreasing internal diameter at least in the upper and lateral portions thereof and opposite end portion 201*c* of reduced diameter cylindrical form received within the hydraulic pumping head portion 200*d* of the outer shell.

The transition from cylindrical portion 201*a* to cylindrical portion 201*c*, through portion 201*b*, is shown as an off-set frusto-conical configuration of the type seen in U.S. Pat. No. 3,759,318 to Putney et al, supra. The object of this configuration is to provide a restricting zone within the circulating tube 201 moving from left to right in the view of FIG. 17 approaching the impeller, yet provide essentially a flat or straight bottom wall in the circulation tube. This minimizes stratification of phases in the circulation tube approaching the impeller. Alternately, the tube 201 may be congruent with shell 200 with a frusto-conical transition 201*b* but this is not preferred.

A pumping impeller 202 is located in the circulating tube portion 201*c* mounted on shaft 203 which rotates in a bearing mounted in the pumping head 200*d*, sealed by suitable packing plans. Impeller 202 is driven by any suitable prime mover 204.

Nozzles or feed lines 205 may be provided penetrating the shell portion 200*c* and tube portion 201*b* to discharge feed components into the circulating stream immediately before it reaches impeller 202. Alternatively or additionally, a feed pipe (or pipes) 206 may extend through a fitting 206*a* in the shell portion 200*b*, passing axially down the circulating tube also to discharge in front of impeller 202. Suitable braces or spiders 207 locate and position pipe 206 with respect to circulation tube 201.

Impeller 203 is thus arranged for taking suction from circulating tube 201 and discharging into hydraulic pumping head 200*b*. Within the latter, the flow of fluid is reversed and directed into the annular space 208 between the outer shell 200 and circulating tube 201. At the other end of the vessel flow is reversed at the arcuate closure 200*b*, thereafter passing interiorly of the circulating tube at 209, thence into the restricted volume portion defined by tube part 201*b* and thereafter into impeller 202. Axial straightening vanes (not shown) are preferably provided in conventional manner immediately prior to impeller 202 in the circulating tube and in the annulus 208 after flow reversal.

A separate drain nozzle 210 is provided on the underside of outer shell 200 to serve in emptying the shell or machine. Discharge outlet nozzle 211 is provided, typically on the upper surface of the outer shell, for withdrawing the finished blend of components.

The contactor of FIG. 17 does not employ a tube bundle or heat exchange element inside of the circulating tube as is seen in some of the forms previously described. It should be understood that either or both of the outer shell and circulating tube, per se, may be jacketed for circulation of heating or cooling medium within the jacket to provide some heat exchange.

Baffles or baffling 212 (upper) and 213 (lower), schematically designated, is provided within the cylindrical portion of the shell and exteriorly of the cylindrical portion 201*a* of the circulating tube. Additionally, the eccentric frusto-conical expanding tube portion 201*b* is shortened with respect to the frusto-conical shell portion 200*c* in order to provide an expanding throat into the baffled annulus 208.

The baffling schematically indicated at 212 and 213 comprises any one of the forms of annulus baffling seen in FIGS. 12–16, inclusive. This baffling is provided in the annulus between the circulation tube and the outer shell to increase velocity, shear, turbulence and mixing in this zone. The provision of this baffling in the annulus 208 enables a given size of impeller 202 to adequately pump and mix fluids within a larger vessel. This effective pumping and mixing is also enhanced by the use of the eccentric frusto-conical convergence at 201*b* in the circulation tube whereby phase separation and stratification does not occur within the circulation tube 201.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. In a contacting and mixing vessel including:

an elongate casing having a discharge opening and inlets for the fluids to be mixed, a hollow open-ended circulating tube positioned axially within said casing and spaced from the interior wall thereof forming an annular passage therewith, an impeller received within and positioned adjacent one end of the circulating tube for mixing and creating a cyclic flow of fluids through said tube and in the annular space surrounding said tube, and a circulating head forming the end of the casing adjacent the impeller, the improvement which comprises:

the circulating tube closely spaced adjacent to the interior wall of the casing whereby the annular space therebetween is minimal thereby to produce a high velocity of fluids flowing therethrough and a plurality of baffles positioned interiorly of said circulating tube, spaced along the length thereof and extending at substantial right angles to the longitudinal axis of said tube, said baffles of sufficient number and such configuration that the flow velocity of the fluids within the circulating tube is substantially increased over the flow velocity thereof in the unimpeded circulation tube, said fluids flowing within the circulating tube additionally subjected to shear, change of flow direction and increased flow distance in the tube because of the presence of said baffles.

2. A vessel as in claim 1 wherein the casing and the tube are substantially congruent in configuration and each has a relatively large internal diameter cylindrical section and a relatively small internal diameter cylindrical section, same spaced apart by a substantially frusto-conical section, the impeller is received within the smaller internal diameter cylindrical section of the tube, and the baffles in the tube are all received in the larger internal diameter cylindrical section.

3. In a contacting and mixing vessel including:

an elongate casing having a discharge opening and inlets for the fluids to be mixed, a hollow, open-ended circulating tube positioned axially within said casing and spaced from the interior wall thereof forming an annular passage therewith, an impeller received within and positioned adjacent one end of the circulating tube for mixing and creating a cyclic flow of fluids through said tube and in the annular space surrounding said tube, a circulating head forming the end of the casing adjacent the impeller and, heat exchange means penetrating the other end wall of the casing and extending into the other end of said circulating tube, said heat exchanging means extending substantially the length of said circulating tube and of an outer diameter substantially that of the inner diameter of the tube, the improvement which comprises:

the circulating tube spaced a substantial distance away from said casing interior wall whereby the annular space therebetween is of considerable volume thereby to ordinarily produce a relatively low velocity of fluid flow therethrough, and a plurality of baffles positioned interiorly of the annular space between said casing and circulating tube and spaced along the length thereof, same extending at substantial right angles to the longitudinal axis of the casing, said baffles of sufficient number and such configuration that the flow velocity of the fluids within the annular space is substantially increased over the flow velocity thereof in the unimpeded annulus, said fluids flowing within said annular space additionally subjected to shear, change of flow direction and increased flow distance in the said annular space because of the presence of said baffles.

4. A vessel as in claim 3 wherein the casing and the circulating tube are substantially congruent in configuration and each has a relatively large internal diameter cylindrical section and a relatively small internal diameter cylindrical section, same spaced apart by an intermediate frusto-conical section, the impeller is received within the smaller internal diameter cylindrical section, and the baffles in the annular space are all received between the uniform diameter cylindrical tube and casing sections.

5. A vessel as in claim 4 wherein the relatively large internal diameter cylindrical section of the circulating tube is of greater length than the corresponding casing section and the intermediate frusto-conical section of the circulating tube is of lesser length than the corresponding casing section.

6. In a contacting and mixing vessel including:

an elongate casing having a discharge opening and inlets for the fluids to be mixed, a hollow open-ended circulating tube positioned axially within said casing and spaced from the interior wall thereof forming in annular passage therewith, an impeller received within and positioned adjacent one end of the circulating tube for mixing and creating a cyclic flow of fluids through said tube and in the annular space surrounding said tube, a circulating head forming the end of the casing adjacent the impeller, and heat exchange means penetrating the other end wall of the casing and extending only a portion of the length of said circulating tube and having an outer diameter substantially that of the inner diameter of the tube, the improvement which comprises:

the circulating tube spaced a substantial distance away from said casing interior wall whereby the annular space therebetween is of considerable volume, thereby to ordinarily produce a relatively velocity of fluids flowing therethrough, a plurality of baffles positioned interiorly of said circulating tube and spaced along the length thereof between the heat exchange means and the impeller, the baffles extending at substantial right angles to the longitudinal axis of the circulating tube, said baffles of sufficient number and such configuration that the flow velocity of the fluids within the baffled portion of the circulating tube is substantially increased over the velocity thereof in the unimpeded tube, said fluids flowing within the circulating tube additionally subjected to shear, change of flow direction and increased flow distance in the tube because of the presence of said baffles, and a plurality of baffles positioned interiorly of said annular space, spaced along the length thereof and extending at substantial right angles to the longitudinal axis of the casing, said baffles of sufficient number and such configuration that the flow velocity of the fluids within said annular space is substantially increased over the flow velocity thereof in the unimpeded annulus, said fluids flowing within said annular space additionally subjected to shear, change of flow direction and increased flow distance in the annular space because of the presence of said baffles.

7. A vessel as in claim 6 wherein the casing and the circulating tube are substantially congruent in configuration and each has a relatively large internal diameter cylindrical section and a relatively small internal diameter cylindrical section, same spaced apart by substantially frusto-conical section, the impeller received within the smaller internal diameter cylindrical section, the baffles inside the circulating tube all received in the larger internal diameter cylindrical section thereof, and the baffles in the annular space all received between the larger internal diameter cylindrical sections of the circulating tube and casing.

8. An improved contacting and mixing vessel comprising, in combination, an elongate casing having a discharge opening and inlets for the fluids to be mixed, a first hollow, open-ended circulating tube positioned axially within said casing and spaced from the interior wall thereof forming an annular passage therewith, an impeller received within and positioned adjacent one end of the circulating tube for mixing and creating a cyclic flow of fluids through said tube and in the annular space surrounding said tube, a circulating head forming the end of the casing adjacent the impeller, heat exchange means penetrating the other end wall of the casing and extending into the other end of the first circulating tube, said heat exchanging means extending substantially the length of said circulating tube and of an outer diameter substantially less than the inner diameter of the first circulating tube, the first circulating tube closely spaced adjacent to the interior wall of the casing whereby the annular space therebetween is minimal, thereby to produce a relatively high velocity of fluids flowing therethrough, a second circulating tube positioned inside said casing and said first circulating tube receiving the heat exchange means therewithin, the internal diameter of the second circulating tube substantially that of the outer diameter of the heat exchanging means, a plurality of baffles positioned interiorly of said first circulating tube and exteriorly of said second circulating tube, spaced along the respective lengths thereof in the annular space therebetween and extending at substantial right angles to the longitudinal axes of said tubes said baffles of sufficient number and such configuration that the flow velocity of the fluids within the second circulating tube containing the heat exchanging means is substantially increased over the flow velocity in the unimpeded annular space, said fluids flowing within the annular space between the circulating tubes additionally subjected to shear, change of flow direction and increased flow distance in the said annulus because of the presence of said baffles.

9. A vessel as in claim 8 wherein the casing and the first circulating tube are substantially congruent in configuration, and each has a relatively large internal diameter cylindrical section and a relatively small internal diameter cylindrical section, same spaced apart by a substantially frusto-conical section, the impeller is received within the smaller internal diameter cylindrical section of the first circulating tube, the heat exchanging means and second circulating tube are each substantially received within the relatively large internal diameter cylindrical section of the first circulating tube, and the baffles are all received in the annulus between the second circulating tube and the relatively large internal diameter cylindrical section of the first circulating tube.

10. In a contacting and mixing vessel including:

an elongate casing having a discharge opening and inlets for the fluids to be mixed, a hollow open-ended circulating tube positioned axially within said casing and spaced from the interior wall thereof forming an annular passage therewith, an impeller received with and positioned adjacent one end of the circulating tube for mixing and creating a cyclic flow of fluids through said tube and in the annular space surrounding said tube, and a circulating head forming the end of the casing adjacent the impeller, the improvement which comprises:

the circulating tube spaced a substantial distance away from said casing interior wall whereby the annular space therebetween is of considerable volume thereby to ordinarily produce a relatively low velocity of fluid flow therethrough, and a plurality of baffles positioned interiorly of the annular space between said casing and circulating tube and spaced along the length thereof, same extending at substantial right angles to the longitudinal axis of the casing, said baffles of sufficient number and such configuration that the flow velocity of the fluids within the annular space is substantially increased over the flow velocity thereof in the unimpeded annulus, said fluids flowing within said annular space additionally subjected to shear, change of flow direction and increased flow distance in the said annular space because of the presence of said baffles.

11. A vessel as in claim 10 wherein the casing and the circulating tube are substantially congruent in configuration and each has a relatively large internal diameter cylindrical section and a relatively small internal diameter cylindrical section, same spaced apart by an intermediate frusto-conical section of the shell and an intermediate eccentric frusto-conical section of the tube the impeller is received within the smaller internal diameter cylindrical section of the tube, and the baffles in the annular space are all received between the uniform diameter cylindrical tube and casing sections.

12. A vessel as in claim 11 wherein the relatively large internal diameter cylindrical section of the circulating tube is of greater length than the corresponding casing section and the intermediate eccentric frusto-conical section of the circulating tube is of lesser length than the corresponding frusto-conical casing section.

* * * * *